US006958472B2

(12) United States Patent
Zubarev

(10) Patent No.: US 6,958,472 B2
(45) Date of Patent: Oct. 25, 2005

(54) MASS SPECTROMETRY METHODS USING ELECTRON CAPTURE BY IONS

(75) Inventor: Roman Zubarev, Uppsala (SE)

(73) Assignee: Syddansk Universitet, Odense (DK)

( * ) Notice: Subject to any disclaimer, the term of this patent is extended or adjusted under 35 U.S.C. 154(b) by 0 days.

(21) Appl. No.: 10/471,454

(22) PCT Filed: Mar. 22, 2002

(86) PCT No.: PCT/DK02/00195

§ 371 (c)(1),
(2), (4) Date: Apr. 2, 2004

(87) PCT Pub. No.: WO02/078048

PCT Pub. Date: Oct. 3, 2002

(65) Prior Publication Data

US 2004/0155180 A1 Aug. 12, 2004

Related U.S. Application Data

(60) Provisional application No. 60/277,621, filed on Mar. 22, 2001, and provisional application No. 60/348,368, filed on Jan. 6, 2002.

(30) Foreign Application Priority Data

Mar. 22, 2001 (DK) ..... 2001 00478
Jan. 16, 2002 (DK) ..... 2002 00069

(51) Int. Cl.[7] ..... H01J 49/42

(52) U.S. Cl. ..... 250/281; 250/292; 250/283; 250/288

(58) Field of Search ..... 250/281, 292, 250/283, 288

(56) References Cited

U.S. PATENT DOCUMENTS 4,731,533 A 3/1988 Vestal
4,988,869 A 1/1991 Aberth
5,340,983 A 8/1994 Deinzer et al.
5,374,828 A 12/1994 Boumsellek et al.
5,493,115 A * 2/1996 Deinzer et al. ..... 250/281
6,653,622 B2 * 11/2003 Franzen ..... 250/282
2003/0183760 A1 * 10/2003 Tsybin et al. ..... 250/292

OTHER PUBLICATIONS

R. W. Vachet et al., "Novel Peptide Dissociation: Gas–Phase Intramolecular Rearrangement of Internal Amino Acid Residues", Jun. 18, 1997, pp. 5481–5488, *Journal of the American Chemical Society*, vol. 119, No. 24.

(Continued)

*Primary Examiner*—John R. Lee
*Assistant Examiner*—Zia R. Hashmi
(74) *Attorney, Agent, or Firm*—Harness, Dickey & Pierce, PLC

(57) ABSTRACT

Methods and apparatus are provided to obtain efficient Electron capture dissociation (ECD) of positive ions, particularly useful in the mass spectrometric analysis of complex samples such as of complex mixtures and large biomolecules of peptides and proteins. Due to the low efficiency of ECD as previously used, the technique has so far only been employed with Penning cell ion cyclotron resonance mass spectrometers, where the ions are confined by a combination of magnetic and electrostatic fields. To substantially increase the efficiency of electron capture, the invention makes use of a high-intensity electron source producing a high-flux low-energy electron beam of a diameter comparable to that of the confinement volume of ions. Such a beam possesses trapping properties for positive ions. The ions confined by electron beam effectively capture electrons, which leads much shorter analysis time. The invention provides the possibility to employs ECD in other trapping and non-trapping instruments beside ICR mass spectrometers.

27 Claims, 8 Drawing Sheets

OTHER PUBLICATIONS

R.A. Zubarev et al., "Electron Capture Dissociation of Multiply Charged Protein Cations", Mar. 24, 1998, pp. 3265–3266, *Journal of the American Chemical Society*, 1998, 120.

D.M. Horn, et al., "Automated *de novo* Sequencing of Proteins By Tandem High–Resolution Mass Spectrometry", Jun. 16, 2000, pp. 10313–10317, PNAS, vol. 97, No. 19.

R.A. Zubarev et al., Electron Capture Dissociation for Structural Characterization of Multiply Charged Protein Cations, Feb. 1, 2000, pp. 563–573, *Analytical Chemistry*, vol. 72, No. 3.

R. Becker, "Electron Beam Ion Sources and Traps (invited)", Feb. 2000, pp. 816–819, *Review of Scientific Instruments*, vol. 71, No. 2.

C. Hendrickson et al., "Electron Beam Potential Depression as an Ion Trop in Fourier Transform Ion Cyclotron Resonance Mass Spectrometry", Oct. 12, 1994, pp. 161–170, *International Journal of Mass Spectrometry and Ion Processes 141*.

R. W. Giese et al., "Electron–Capture Mass Spectrometry: Recent Advances", 2000, pp. 329–346, *Journal of Chromatography A*. 892.

E.N. Beebe et al., "An Electron Beam Ion Source For Laboratory Experiments", Feb. 11, 1992, pp. 3399–3411, *Rev. Sci. Instrum. 63* (*6*).

* cited by examiner $M^{2+}$: $\overset{c}{z^{\cdot}}$ pE Q R L G N Q W A V G H L M-$NH_2$ $[b]^{2+}$: $\overset{c}{z^{\cdot}}$ pE Q R L G N Q W A V G H L-CO

MASS SPECTROMETRY METHODS USING ELECTRON CAPTURE BY IONS

This application is a 371 of PCT/DK02/00195, filed Mar. 22, 2002, which claims benefit of 60/277,261 filed Mar. 22, 2001, and claims benefit of 60/348,368, filed Jan. 16, 2002.

FIELD OF THE INVENTION

The present invention relates to ion fragmentation techniques useful with tandem mass spectrometry.

BACKGROUND OF THE INVENTION

Mass spectrometry is an analytical technique where ions of sample molecules are produced and analysed according to their mass-to-charge (m/z) ratios. The ions are produced by a variety of ionisation techniques, including electron impact, fast atom bombardment, electrospray ionisation and matrix-assisted laser desorption ionisation. Analysis by m/z is performed in analysers where the ions are either trapped for a period of time or fly through towards the ion detector. In the trapping analysers, such as quadrupole ion trap (Paul trap) and ion cyclotron resonance (ICR cell or Penning trap) analysers, the ions are spatially confined by a combination of magnetic, electrostatic or alternating electromagnetic fields for a period of time typically from about 0.1 to 10 seconds. In the transient-type analysers, such as magnetic, quadrupole and time-of-flight analysers, the residence time of ions is shorter, in the range of about 1 to 100 $\mu$s.

Tandem mass spectrometry is a general term for mass spectrometric methods where sample ions of desired mass-to-charge are selected and dissociated inside the mass spectrometer and the obtained fragment ions are analysed according to their mass-to-charge ratios. Dissociation of mass-selected ions can be performed either in a special cell between two m/z analysers, or, in trapping instruments, inside the trap. Tandem mass spectrometry can provide much more structural information on the sample molecules.

To fragment ions inside the mass spectrometer, collisionally-induced dissociation (CID) is most commonly employed. In the predominant technique, the m/z-selected ions collide with gas atoms or molecules, such as e.g. helium, argon or nitrogen, with subsequent conversion of the collisional energy into internal energy of the ions. Alternatively, ions may be irradiated by infrared photons (infrared multiphoton dissociation, IRMPD), which also leads to the increase of the internal energy. Ions with high internal energy undergo subsequent dissociation into fragments, one or more of which carry electric charge. The mass and the abundance of the fragment ions of a given kind provide information that can be used to characterise the molecular structure of the sample in question.

Both collisional and infrared dissociation techniques have serious drawbacks. Firstly, increase of the internal temperature causes intramolecular rearrangements that can lead to erroneous structure assignment, as discussed in Vachet, Bishop, Erickson and Glish, (1997) *Am. Chem. Soc.* 119: 5481–5488. Secondly, low-energy channels of fragmentation dominate, which can limit the multiplicity of cleaved bonds and thus the fragmentation-derived information, and in case of the presence of easily detachable groups result in the loss of information on their location. Finally, both collisional and infrared dissociations become ineffective for large molecular masses.

To at least partially overcome these problems, electron capture dissociation (ECD) has recently been proposed (see Zubarev, Kelleher and McLafferty (1998), *J. Am. Chem. Soc.* 120: 3265–3266).

The ECD technique is technically related but physically different from earlier work of using high-energy electrons to induce fragmentation by collisions with electrons (Electron Impact Dissociation, EID). U.S. Pat. No. 4,731,533 describes the use of high-energy electrons (about 600 eV) that are emitted radially on an ion beam to induce fragmentation. Similarly, U.S. Pat. No. 4,988,869 discloses the use of high-energy electron beams 100–500 eV, transverse to a sample ion beam to induce fragmentation. The method suffers though from low efficiency, with a maximum efficiency of total fragmentation of parent ions of about 5%.

In contrast to EID, in the ECD technique positive multiply-charged ions dissociate upon capture of low-energy (<1 eV) electrons in an ion cyclotron resonance cell. The low-energy electrons are produced by a heated filament. Electron capture can produce more structurally important cleavages than collisional and infrared dissociations. In polypeptides, for which mass spectrometry analysis is widely used, electron capture cleaves the N—$C_\alpha$ backbone bonds, while collisional and infrared excitation cleaves the amide backbone bonds (peptide bonds). Combination of these two different types of cleavages provides additional sequence information (Horn, Zubarev and McLafferty (2000), *Proc. Natl. Acad. Sci. USA,* 97: 10313–10317). Moreover, disulfide bonds inside the peptides that usually remain intact in collisional and infrared excitations, fragment specifically upon electron capture. Finally, some easily detachable groups remain attached to the fragments upon electron capture dissociation, which allows for determination of their positions.

The drawback of current electron capture dissociation methods lies in their relatively low efficiency, which manifests in the long time of electron irradiation. In order to obtain electron capture by a desired proportion of polypeptide parent ions, at least several seconds of irradiation is required for doubly-charged parent ions (see Zubarev et al. (2000) *Anal. Chem.* 72: 563–573). Typical parameters for the ECD technique are described in Zubarev (2000) ibid. Electron beams of 0.3–1 $\mu$A are used with average electron energy of about 0.5 or 1.0 eV. The higher currents are not found to provide more efficient ECD. It is stated that ECD requires a near-zero translational energy difference between the ions and electrons. When admitting different energy populations of electrons to the ICR cell, it is found that the lower energy electrons provide higher ECD efficiency.

This long irradiation time reduces the duty cycle of the mass spectrometer to 3–10%. In electrospray ionisation, sample ions are produced continuously and only a small fraction of these ions can be analysed in ECD experiments due to the poor duty cycle, resulting in low sensitivity. In addition, electron capture dissociation is an energetic process, resulting in scattering of the fragments. Insufficient collection of produced fragment ions additionally decreases the sensitivity. The long irradiation time makes electron capture dissociation possible only on ion cyclotron resonance m/z analysers that are among the most expensive types of mass spectrometers, and not in common use. Indeed, in transient analysers the residence time of ions is too short for effective electron capture. In Paul ion traps, the presence of alternating electromagnetic field of several hundred volts amplitude would rapidly deflect the beam or otherwise increase the kinetic energy of electrons above 1 eV, with the cross section for electron capture dropping by at least three orders of magnitude.

For these reasons, it would be desirable to shorten the ion-electron reaction and improve the efficiency of collection of fragments to make ECD more useful. It would be further highly desirable to allow the ECD technique to be used in other types of mass spectrometers.

SUMMARY OF THE INVENTION

According to the present invention, methods are provided for producing effective electron capture dissociation of positive ions in tandem mass spectrometry. A high-flux, broad electron beam is used that traverses essentially the full width of a region occupied by parent ions for at least a period of time. The beam produces potential depression along its axis, that is at least as large as the kinetic energy of motion of ions radially to the beam axis. The ions thus become trapped within the volume occupied by the electron beam during the time of electron irradiation, thereby offering effective capture by the ions of low-energy electrons present in the beam. The fragment ions formed as a result of the electron capture will also be trapped inside the beam, which results in their effective collection.

The invention provides in a further aspect a mass spectrometer for employing the methods of the invention, such a mass spectrometer having an electron source providing an electron beam of sufficient density to trap ions and where at least a part of the electron beam is of low enough energy to provide electron capture by at least a portion of the trapped ions.

Figure 1:
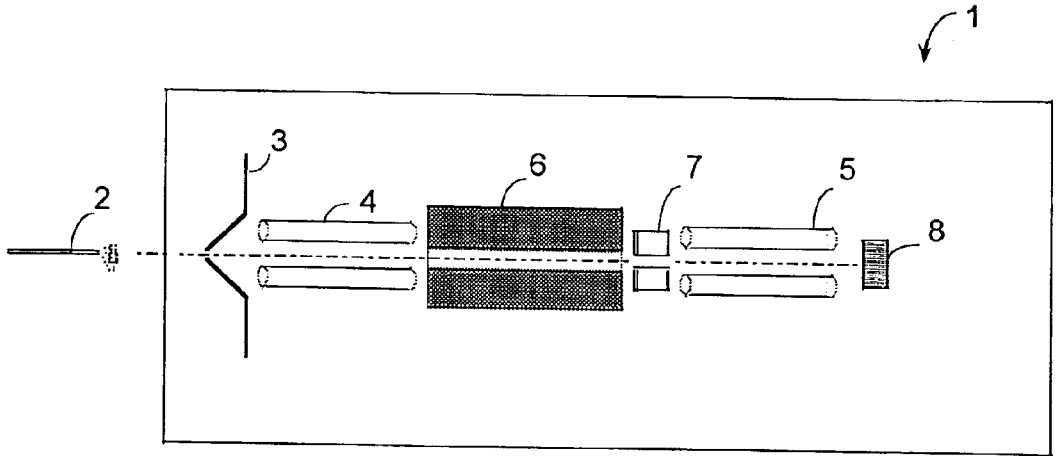
FIG. 1 is a block diagram of a tandem mass spectrometer (1) employing an electron source according to the present invention. The mass spectrometer (1) comprises an electrospray ion source (2), an electrospray interface (3), a mass filter (4), a fragmentation cell (6), an electron source (7) a second mass filter (S) and an ion detector (8).

DETAILED DESCRIPTION AND PREFERRED EMBODIMENTS the method of the invention of obtaining electron capture by positive ions for use in mass spectrometry comprises the steps of: providing positive ions located during at least a period of time in a spatially limited region; providing an electron beam which is essentially as broad as said region, and which beam has electron density of sufficient magnitude such that the potential depression created by the electrons is larger or equal to the kinetic energy of the motion radial to said beam of a substantial portion of the ions, to thereby trap said portion of ions; wherein at least a part of the electron beam is of low enough energy to provide electron capture by at least a portion of the trapped ions.

The spatially limited region is typically within a mass spectrometer, or an adjacent space such as within a reaction chamber or a region of an ionisation source, where sample ions are confined or pass through such that they are located within the region for a period of time to interact with an electron beam which is essentially as broad as said region. Note that the spatially limited region need not be confined by the walls/surfaces defining the instrument region which houses the spatially limited region; the spatially limited region is often a subspace within said instrument region.

A force field may suitably be used to assist in locating the positive ions within the spatially limited region, such as a magnetic field, an electric field, an electromagnetic field, or any combination thereof.

The method of the invention for providing electron capture of sample ions will in useful embodiments cause them to dissociate to provide fragment ions. Electron capture dissociation utilises the following ion-electron reaction:

$$[M+nH]^{n+}+e^- \rightarrow \text{fragmentation}$$

where multiply-protonated molecules $[M+nH]^{n+}$ ($n \geqq 2$) are provided, most suitably by electrospray ionisation. (The parent ion needs to have a charge of 2 or higher, to obtain at least one charged fragment after capture of an electron wherein the positive charge is decreased by one unit charge.) The cross section of electron capture rapidly decreases with electron energy, and therefore for effective reaction, the electrons (or a substantial portion thereof) should preferably have kinetic energy below about 1 eV, more preferably below about 0.5 eV, and more preferably about 0.2 eV or less. The cross section of electron capture is also quadratically dependent upon the ionic charge state, meaning that capture by doubly charged ions is four times more efficient than by singly-charged ions.

Therefore, the less charged fragments that are formed from the parent ions capture electrons with a very low rate compared with the parent ions.

It has however, surprisingly been found by the applicant, that "hot" electrons with energies in the range of about 2–14 eV, and preferably 3–13, such as about 6–12 eV can also be used for electron capture dissociation according to the current invention. This variant of ECD termed herein 'HECD' (hot ECD) can give significant rate of dissociative capture, provided the flux of electrons is sufficiently high.

It is postulated herein that such hot electrons are captured directly and simultaneously produce electronic excitation. They thus are of low enough energy to provide electron capture by at least a portion of the trapped ions. This effective variant method of ECD has to our knowledge not been tried or suggested in the prior art.

As discussed in the accompanying Example 2, the hot electron capture dissociation reaction is separated on the energy scale from what may be called "normal" ECD (i.e. ECD using electrons of energies lower than about 1 eV as discussed above) by a region which is about 2–3 eV wide, in which region significantly less fragmentation is observed.

It is noted that the excess energy in HECD is typically dissipated in secondary fragmentation reactions, such as losses of .H and larger radical groups near the position of primary cleavage. This has a useful feature of the formation of even-electron d and w species from a. and z. radical fragments by a loss from the side chain adjacent to the radical site. For isoleucine and leucine, the lost groups are $.C_2H_5$ and $.C_4H_7$, respectively, which allows for distinguishing between these two isomeric amino acid residues. This is illustrated with the formation of w fragments in Scheme 1:

Scheme 1

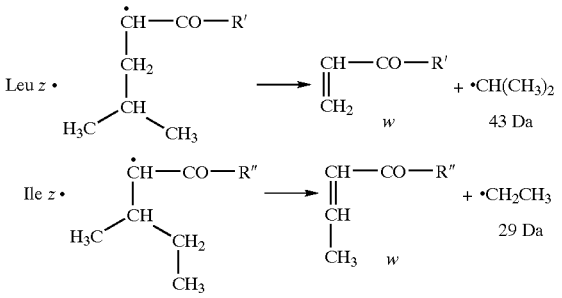

The terminology used herein for peptide fragmentation is that of a conventional usage (Scheme 2).

Scheme 2

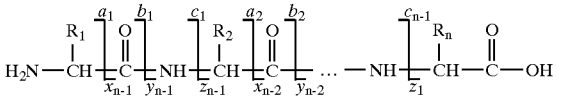

For backbone cleavage, rupture of the C—N bond cleavage gives N-terminal b and C-terminal y products; N—$C_\alpha$ bond cleavage produces N-terminal c and C-terminal z fragments; $C_\alpha$—C cleavage yields N-terminal a and C-terminal x fragments. The presence of an unpaired electron is shown as a radical sign, the loss of a hydrogen atom is shown by the absence of the radical sign; the presence of an extra hydrogen atom compared to homolytic cleavage is given by.

Positive ions suitably analysed with the current invention include many different classes of chemical species that can be ionized to provide multiply charged ions, e.g. polymers, carbohydrates, and biopolymers, in particular proteins and peptides, both, including modified proteins and peptides. The term polypeptide is used herein to encompass both proteins and parts of proteins as well as shorter (2 to 10 amino acid residues) and longer peptides such as between 10 to 100 residues in length.

It is postulated herein that contrary to what has been suggested by the prior art, it is not the difference in translational energies between electrons and ions which is critical for efficient electron capture, but rather the difference in velocities. As velocity is a function of the energy of a particle divided by its mass, and the mass difference between electrons and sample ions is at least 2000-fold, electrons of low energy as mentioned above are preferable for sample ions of quite varying energies.

Although the concept of electron capture dissociation is not novel per se, as discussed above, the prior art fails to provide techniques for effectively obtaining this objective, particularly in other types of instrumentation than ion cyclotron resonance mass spectrometers.

The present invention reaches this objective by utilizing the property of the electron beam to attract positive ions and to trap them. High-intensity low-energy electron breams have never been used before to both trap ions and produce electron capture by trapped ions and subsequent electron capture dissociation, nor has such use been suggested by the prior art.

The potential depression (trapping potential) V, produced by an electron beam may be described by the following equation (I):

$$V[\text{eV}]=15.5\cdot I_e[\text{mA}]/\{(E_e[\text{eV}])^{1/2}\cdot(a\ [\text{mm}])^2\} \quad \text{(I)}$$

where $I_e$ is the electron current and $E_e$ is the electron energy, a is the electron beam diameter (see Hendrickson, Hadjarab and Laude (1995) *Int. J. Mass Spectrom. Ion Processes,* 141: 1161–170). The trapping conditions are met when the potential depression is larger than the kinetic energy of ions. Specifically, it is important to consider the kinetic energy of the escaping motion of ions, i.e. the motion perpendicular to the direction of the electron beam.

If the average kinetic energy of escaping motion of ions is, e.g. 1 eV, a trapping potential of at least 1 eV is desired: when the electron energy is 1 eV and the beam diameter of 1.6 $mm^2$, a current of 100 $\mu$A is required. This is much greater than the current of 0.3 to 1 $\mu$A recommended in the prior art (see Zubarev (2000) ibid.) for the earlier ECD methods.

The total amount, $N_q$ of the ions that can be trapped inside the electron beam may be calculated by equation (II):

$$N_q=3.33\cdot10^3\cdot I_e[\mu\text{A}]\cdot L\ [\text{cm}]/(E_e[\text{keV}])^{1/2} \quad \text{(II)}$$

where L is the length of the trapping region (see Beebe and Kostroun (1992) *Rev. Sci. Instr.* 63: 3399–3411). For a typical quadrupolar ion trap with L=2 mm, a maximum number of trapped ions of $N_q=2\cdot10^6$ is obtained. In a Penning trap (ICR cell), L is typically significantly longer, providing possible trapping of a higher number of ions. Since both Paul and Penning ion traps normally contain no more than $10^6$ charges, an electron beam with parameters such as above is capable of trapping essentially all the ions.

Consequently, sufficient electron density according to the invention will depend on the dimension of the trapping region, the average energy of the electrons, the energy of ions to be trapped, and the width of the electron beam, but may of about 50 $\mu A/mm^2$ or higher, such as about 100 $\mu A/mm^2$ or higher, such as in the range of about 100 $\mu A/mm^2$ to 1 $A/mm^2$, but generally a density of about 100 $\mu A/mm^2$ to 1 $mA/mm^2$ will suffice the criteria of the invention. Such electron densities may typically be obtained with emitted electron currents on the order of about 50 $\mu$A to about 5 mA, such as in the range of about 100 $\mu$A to about 2 mA, such as about 200 $\mu$A to 1 mA, or about 100–500 $\mu$A.

In embodiments where the ions to be reacted with the electrons pass through as a beam, such as in a quadrupole ion guide or reaction cell, or in an ICR where ions are confined radially along the central axis of a magnetic field, it is highly beneficial for efficient trapping, that the electron beam is essentially axial to the direction of the ion beam.

Although, as discussed above, the electron beam trapping of ions and electron capture will often provide useful fragment spectra, in other advantageous embodiments, additional fragmentation means are applied to dissociate the ions that have captured electrons. These species will typically show different fragmentation pattern than the corresponding "pre-ECD" ions with the respective fragmentation techniques, and thus spectra obtained may provide additional information as compared to using only ECD or only the additional fragmentation means. The additional fragmentation means are, e.g. means to provide collisionally activated dissociation; a source of electromagnetic irradiation, in particular such as an infra-red laser, or a source of blackbody radiation.

The electron beam used according to the invention is either a continuous or a pulsed electron beam, and this may depend on the type of instrument used and the time-window during which the electron beam can interact with the ions of interest.

In particularly useful embodiments, the methods of the invention are applied for tandem mass spectrometry, where positive ions are selected of desired mass-to-charge ratio prior to electron capture and fragmentation, or alternatively after the step of electron capture but prior to applying other fragmentation means to obtain fragment ion of the selected parent ions that have captured electrons.

As is apparent from the description herein, the invention provides useful methods of obtaining mass spectra of fragment ions of a sample, where such methods comprise the steps of: obtaining electron capture dissociation of sample ions by the methods described herein; detecting the mass-to-charge ratio of obtained fragment ions with a mass spectrometry detector to obtain a mass spectrum of the fragment ions. Alternatively, the fragments are obtained by applying other dissociation means such as those above mentioned, to ions that have captured electrons by use of the methods of the invention.

In another aspect of the invention, a mass spectrometer is provided suitable for realizing the methods of the invention. A mass spectrometer according to the invention for the analysis of samples comprises an ion source to provide positively charged ions; means to locate at least a portion of said positively charged ions during at least a period of time in a spatially limited region such as described above; an electron source which source provides an electron beam which is essentially as broad as said spatially limited region; wherein the electron density of said electron beam is of sufficient magnitude such that the attractive potential of the electrons in the beam is larger than or equal to the average kinetic energy of the motion of the trapped ions radial to said beam, and wherein at least a part of the electron beam is of low enough energy to provide electron capture by at least a portion of the trapped ions; a detector to detect the mass to charge ratio of sample ions; output means to provide a mass spectrum of said detected sample ions.

As mentioned above, it is preferable that the mass spectrometer of the invention has an electron source that provides the electron beam essentially axial to the direction of the beam of ions, in the embodiments where the ions are provided as a beam, or confined axially along a central axis; or—such as where ions are not confined substantially axially along a central axis—that the electron beam is essentially axial to the direction entrance trajectory into the spatially limited region of said positive ions.

In preferred embodiments, the mass spectrometer of the invention has an electrospray ion source as such an ion source is particularly effective in providing positive multiply charged ions for many types of sample ions and molecules in various sample solvents. However, other ion sources may as well be employed according to the invention, provided that positive sample ions are provided with an ionic charge of 2 or higher. Such other sources include matrix-assisted laser desorption ionization (MALDI), thermospray, electron impact, and fast atom bombardment (FAB) sources.

It will be appreciated that the mass spectrometer of the invention may be of any of the most commonly used types, provided they comprise the necessary features for execution of the methods of the invention. These include a Fourier transform ion cyclotron resonance (FT-ICR) mass spectrometer, triple-quadrupole mass spectrometer, ion trap mass spectrometer, or hybrid instruments such as quadrupole-time of flight mass spectrometers. The actual configuration and dimension of the region in which ions are located for at least a period of time to interact with the electron beam will depend on the particular type of mass spectrometer used. Particular embodiments are discussed in greater detail below. The region may, e.g. be within a quadrupole ion trap, a Penning trap of an ICR mass spectrometer, or a multipole ion guide/mass filter.

As mentioned above, it can be useful to have a force field assisting in the location of the positive ions within the spatially limited region, such as a magnetic field, an electric field, an electromagnetic field, or any combination thereof. An FT-ICR mass spectrometer will inherently have a strong magnetic field which is beneficial in this respect. However, in other types of mass spectrometers which conventionally would not employ a magnetic field in the space comprising the spatially region, a magnetic field may be provided for the purpose of assisting in the location of ions within the spatially limited region, according the current invention.

In a preferred useful embodiment, the mass spectrometer of the invention is a tandem mass spectrometer. Such a tandem mass spectrometer comprises suitable means to select ions of desired mass to charge ratio to be located in the spatially limited region prior to the step of electron capture, or alternatively to select ions after electron capture for subsequent fragmentation.

Exemplifying embodiments of three of the above-mentioned mass spectrometers are described in more detail below:

ECD in an Ion Cyclotron Resonance Mass Spectrometer

In a first particular embodiment, the electrons are produced by a dispenser cathode of a circular shape placed on-axis outside the cell of an ion cyclotron resonance mass spectrometer. The cathode diameter is about 1.3 mm, and it produces current of up to 1 mA at the electron energy of 1 eV. This electron beam essentially fully covers the cloud of ions stored inside the cell and traps them in the radial direction. The electron energy is below 1 eV in the center of the cell, which results in effective electron capture by the ions. The trapping potential of the electron beam is at least 0.5 V, which is sufficient to confine the produced fragments.

Figure 2:
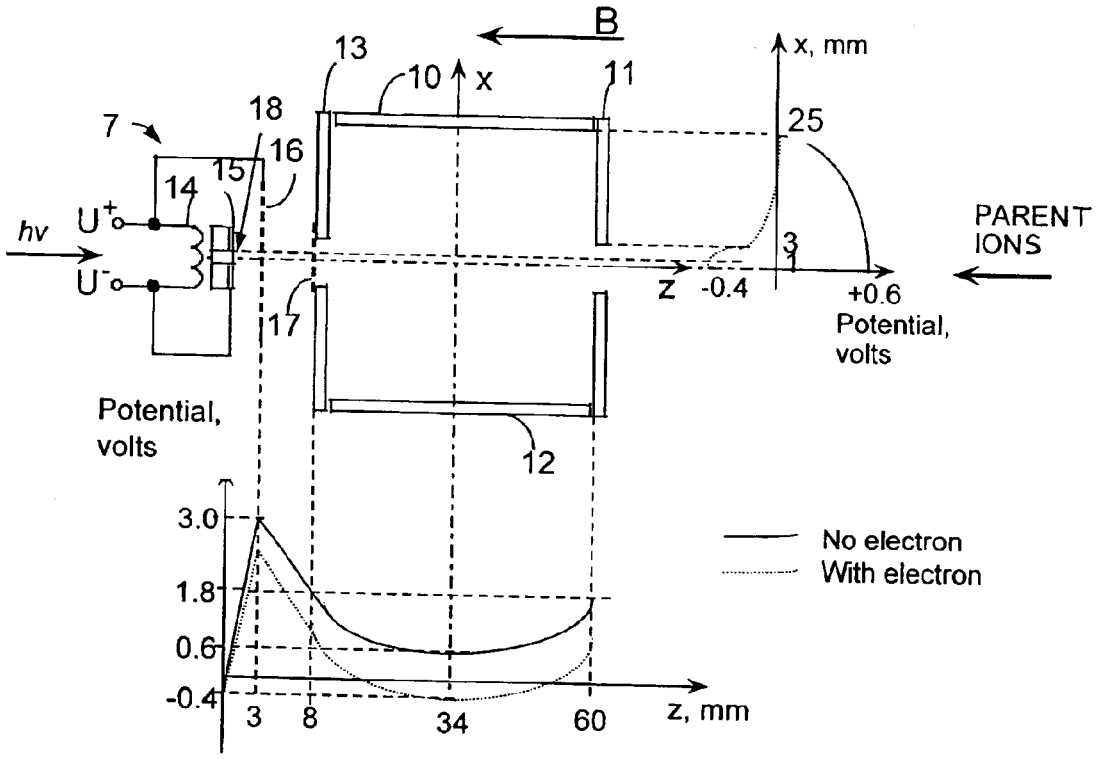
FIG. 2 is a diagram of an ion cyclotron resonance mass spectrometer according to the present invention with a graph illustrating the potential field on the axis of the ion cyclotron resonance cell perpendicular (x) and parallel (z) to the magnetic field B.

A particular embodiment of the above type is illustrated in FIG. 2 that presents a schematic diagram of a rectangular ion cyclotron resonance cell composed of six metal electrodes, four of which are shown. The cell (10) is placed centrally along the magnetic field B of a superconducting magnet with a strength which is typically between 3 and 9.4 Tesla. It must be noted however that the actual shape of the cell and the composing electrodes, as well as the actual strength of the magnet, are not important for the present invention. To the trapping electrodes 11 and 13, a trapping potential between about 0.5 and 5 V is applied. For the calculations of the present embodiment, +1.8 V potential was selected. The other four electrodes of the cell may have a potential near zero, by means of which a potential minimum is created in the center of the cell on the axis z, parallel to the magnetic field as shown by the lower diagram. The parent ions come into the cell through the hole in the trapping electrode 11 and become trapped in the cell by a combination of the magnetic and electrostatic field. After multiple collisions with a rest gas (e.g., nitrogen or argon, provided by a pulse valve), the ions collect in the center of the cell in the form of a cloud of about 0.2 to 2 mm in diameter. The trapping in the direction x is due to the magnetic field and is not permanent because of the presence of the potential maximum of the electrostatic field in the plane perpendicular to the magnetic field, as shown by the potential diagram to the right.

Opposite to the exit hole in the electrode 13 and perpendicular to the axis z, an electron source 7 is placed comprising a heating filament 14 and the emitting surface 15. The surface 15 with an area on the range of about 1 to 50 $mm^2$ may be preferably made of tungsten and covered by a material with a low work function, such as preferably barium oxide. The filament has two contacts to which positive $U^+$ and negative $U^-$ potentials are applied, with the potential difference between about 3 to 12 V depending upon the desired electron current in the calculations of the present embodiment, the potential difference of 6 V is used. The magnitude of the electrical current through the filament depends on the filament resistance, and can be between about 0.3 and 5 A. The emitting surface 15 is electrically connected to a potential $U^-$. In front of the emitting surface 15, an optional flat grid 16 is placed made of non-magnetic metal such as gold, copper or stainless steel. A potential positive in respect to the emitting surface 15 is applied to the grid 16 in order to assist electron emission from the surface. The electrons ejected from the surface 15 are accelerated by the grid 16 and come into the cell through a hole of electrode 13, optionally through a grid 17 on the electrode 13. As shown by the potential diagrams, the potential on the axis z becomes lower in the presence of the electron beam, with the maximum in the direction x becoming a minimum. The potential $U^-$ on the emitting surface 15 of the electrode is chosen such that the electron energy in the center of the cell is below 1 eV. The current of the electrons is selected such as to achieve the trapping of positive ions in the x-direction. In the present embodiment, the calculated depth of the potential well is 0.4 eV, as shown on the potential diagram. The combination of the ion trapping and low energy of the electrons ensures effective electron capture by the parent ions, and confinement of the fragments within the electron beam. Due to the low cross section for electron capture, the majority of the fragments will not capture electrons and therefore will not be neutralized. After the desired degree of fragmentation of parent ions is achieved, e.g. after a period in the range of about 10 to 1000 ms, such as about 20–100 ms, the potential $U^-$ is set more positive than the potential on the trapping plate 13, thus terminating the electron current through the cell. The fragments ion can now be excited and detected by conventional ICR-MS methods.

To produce tandem mass spectra of higher order, electron irradiation of a selected fragment ion is performed. The fragments that serve as parent ions in the second fragmentation step are produced from parent molecular ions e.g. by electron capture, or by collisional or infrared dissociation. Infra-red dissociation is preferable, since it is fast, does not require elevated gas pressure in the cell and produces abundant fragments. The Infrared photons (labeled hv on the figure) are conveniently produced by a laser installed outside the mass spectrometer. The optional hole 18 in the electron source ensures the transmission of the infra-red beam into the cell along the axis z. This hole is suitably about 1 to 3 mm in diameter. The presence of the hole makes the bottom of the potential diagram in the x direction more flat, but does not destroy the trapping properties of the electron beam. The lesser amount of electrons on the axis z can be compensated by a more intense electron beam or longer time of irradiation of the parent ions by electrons.

ECD in an Ion Trap Mass Spectrometer

In a second embodiment, a dispenser cathode is placed opposite to the entrance hole into the trapping region of a quadrupole ion trap mass spectrometer, slightly off-axis. During the short electron irradiation event, the amplitude of the oscillating trapping voltage on the cap electrodes is decreased to about 3 V peak-to-peak. During the part of the oscillation cycle when the absolute magnitude of the trapping voltage is above 1 V, the electron beam will be deflected by this voltage. The ions, however, cannot leave the cell because they are experiencing the trapping voltage. During another part of the cycle when the absolute magnitude of the trapping voltage is below 1 V, the ions are trapped primarily by the electron beam. Effective electron capture and fragment retention is achieved during this period of the cycle.

Figure 3:
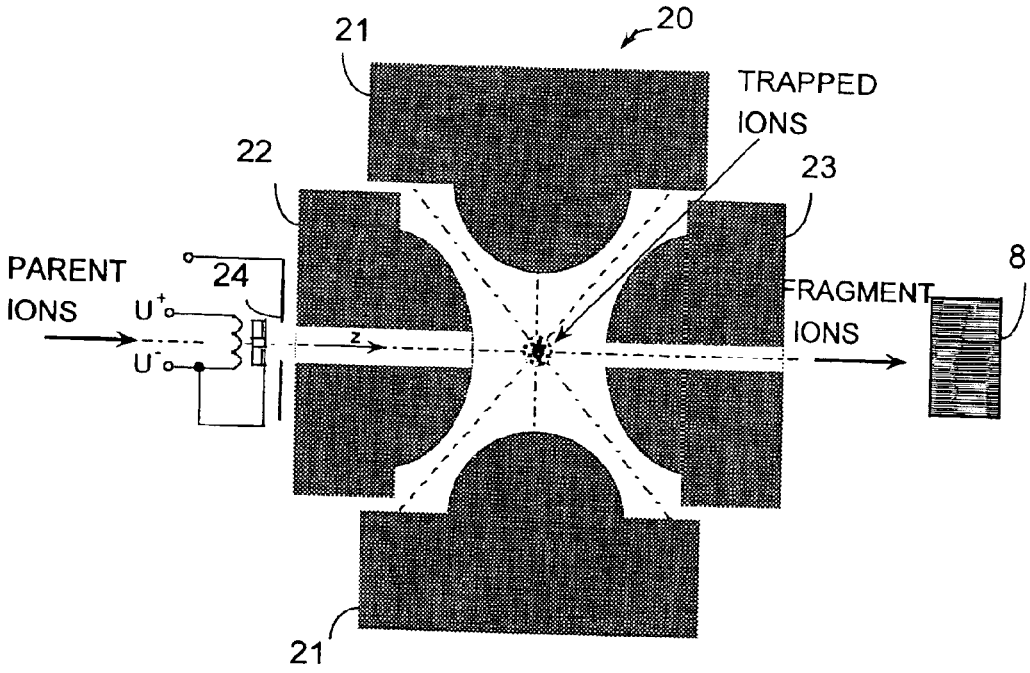
FIG. 3 is a diagram of an ion trap mass spectrometer according to the present invention.

Referring to FIG. 3, a Paul ion trap 20 is shown consisting of the ring electrode 21 and the cap electrodes 22 and 23 as well as the electron source 7. The source 7 is largely similar to the one in the first embodiment above, and contains the central hole through which the parent ions enter the cell 20 and are trapped as customary. The difference in the electron source design as compared to the source described for an ICR MS, is that instead of the grid in front of the emitting surface there is an electrode 24 with a central hole. During the event of filling the trap with ions, the potential on the electrode is negative by 1 to 10 V in respect to the potential on the emitting surface, which prevents electrons from desorbing from the surface and neutralizing the ions passing through the hole. In the filled cell, the trapped ions occupy a central volume of about 2 mm in diameter. During the fragmentation event, the potential on the electrode 24 becomes positive in respect to the potential on the emitting surface, which results in emission of a beam of electrons along the axis z of the cell. Simultaneously, the amplitude of the trapping alternating voltage between the ring electrode 21 and the cap electrodes 22 and 23 is reduced to about 1 to 10 V peak-to-peak. Now the ions are confined in the center of the cell, partially by the electron beam and partially by the alternating voltage, though mostly by the electron beam. After about 10 to 100 ms of electron irradiation, the electron beam is terminated by making the potential on the electrode 24 about 1 to 10 V negative relative to the potential on the emitting surface. The fragment ions are ejected from the Paul cell and detected by the detector 8 as customary.

ECD in a Triple Quadrupole Mass Spectrometer

Figure 4:
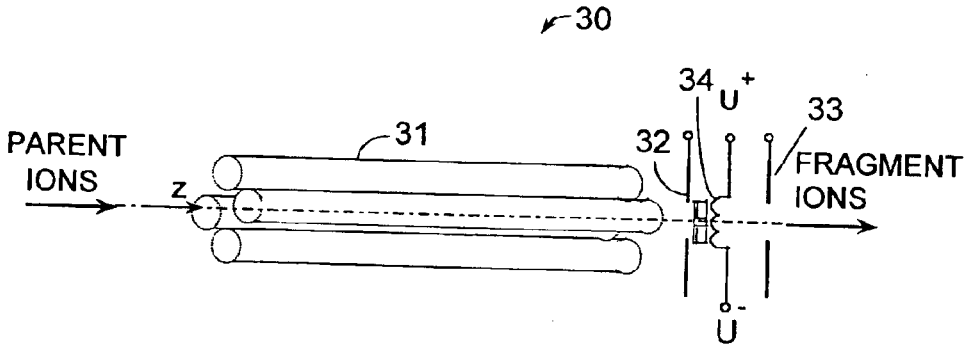
FIG. 4 is a diagram of a quadrupole mass spectrometer according to the present invention.

A third embodiment using a triple quadrupole mass spectrometer is represented in FIG. 1. A more detailed view of the fragmentation cell 30 is shown in FIG. 4, comprising an even number of rods 31 (e.g., quadrupole, hexapole or octupole). As is customary for quadrupole ion guides as mass filters, the rods 31 have circular or hyperbolic surfaces, with every pair of opposite rods connected electrically together. An alternating voltage between the electrodes 31 is applied of a frequency of about 0.5 to 4 MHz, such as preferably about 1 MHz, to ensure ion transmission through the device 30. The amplitude of the alternating voltage is generally about 1 to 10 V peak-to-peak. The electron source 34 is installed on-axis behind the cell 30 with the emitting surface facing the cell. In the cell 30, the transient ion beam with translational energy of about 10 eV per unit ionic charge occupies a central volume of about 2 to 6 mm in diameter. The potential on the electrode 32 is positive by about 1 to 10 V relative to the potential on the emitting surface, which results in emission of a beam of electrons along the axis z of the cell, during which the ion beam is confined partially by the electron beam and partially by the alternating voltage, though mostly by the electron beam. The electron current and energy are selected such that during the transient time period when ions pass through the cell, which is typically about 50 to 100 $\mu$s, a substantial fraction of the parent ions capture electrons. The fragment ions exiting the cell pass through the electrode 32, the central hole in the electron source 34 and the focusing electrode 33 before entering the mass filter (mass filter 5 of FIG. 1).

EXAMPLES

Example 1

Figure 5:
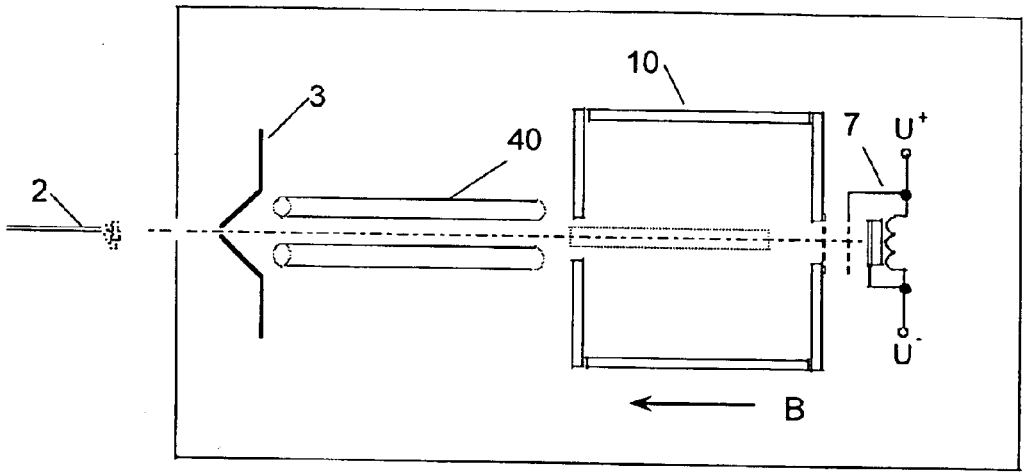
FIG. 5 is a schematic diagram of the instrumental configuration used in the accompanying examples, indicating an electrospray ion source (2), an electrospray interface (3), an ion guide (40), an ion cell (10), and an electron source (7).

A schematic drawing of the instrumental arrangement used for an experimental demonstration of the present invention is shown in FIG. 5. The instrumental configuration comprises an Ultima ion cyclotron resonance mass spectrometer (IonSpec, Irvine, Calif., USA) that has been modified in such a way that the standard filament-based electron source has been replaced by an indirectly heated dispenser cathode with an emitting surface of 1.6 $mm^2$. The cathode was obtained from PO Horizont, Moscow, Russia. The operating potentials are $U^+$=+5 V, $U^-$=−1 V during the electron irradiation event, and $U^+$=+15 V, $U^-$=+9 V during all other events. The current through the cathode is 0.6 A in all cases. The emitting surface is electrically connected with $U^-$. In front of the emitting surface, a 80% transparent copper mesh grid is installed and connected to $U^+$. The same type of grid is installed on the trapping plate of the rectangular ion cyclotron resonance cell. The distance between the two grids is 3 mm, the distance between the emitting surface and the first grid is also 3 mm. The potential on the trapping plates during electron irradiation is +3 V. The electron current measured on this grid during the irradiation event is 1 mA. The cell and the electron source are placed in the field of a 4.7 Tesla superconducting magnet (Cryomagnetics, Oak Ridge, Tenn., USA). The primary ions are produced by an electrospray ion source and transmitted into the mass spectrometer by an electrospray interface (Analytica of Branford, Boston, Mass., USA) and then to the cell by a 1.2 m long quadrupole ion guide. The parent ions guided into the cell are trapped therein by manipulating the potential on the trapping plate as described in the paper by Senko, Hendrickson, Emmet, Shi and Marshall (1997), *J. Am. Soc. Mass Spectrom.* 8: 970–976. During the electron beam event the ions are also trapped by the electron beam.

Figure 6:
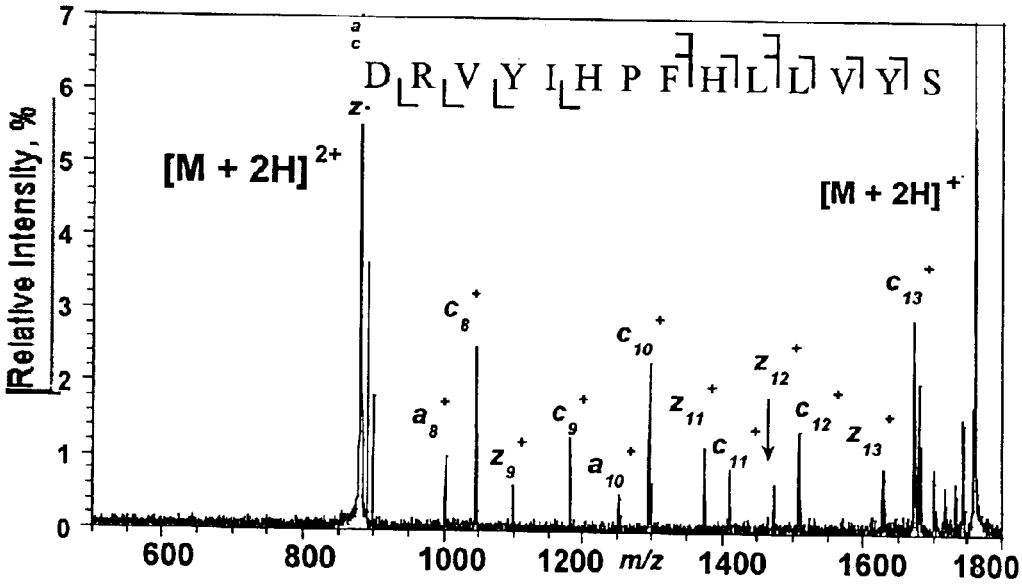
FIGS. 6–7 show mass spectra obtained by the invention, as described in Example 1.

As FIG. 6 demonstrates, an electron capture dissociation spectrum is obtained with electron irradiation lasting just 1 ms, compared to beam times of 1–3 seconds used in prior art ECD methods (Zubarev (2000), ibid.). Most bonds between the amino acid residues are broken by electron capture dissociation that produced a,c and z fragments in the conventionally accepted notation (see Roepstorff and Fohiman (1984), *Biomed. Mass Spectrom.* 11: 601). This dramatic shortening of the irradiation event allows for integrating more data, which leads to higher sensitivity.

Figure 7:
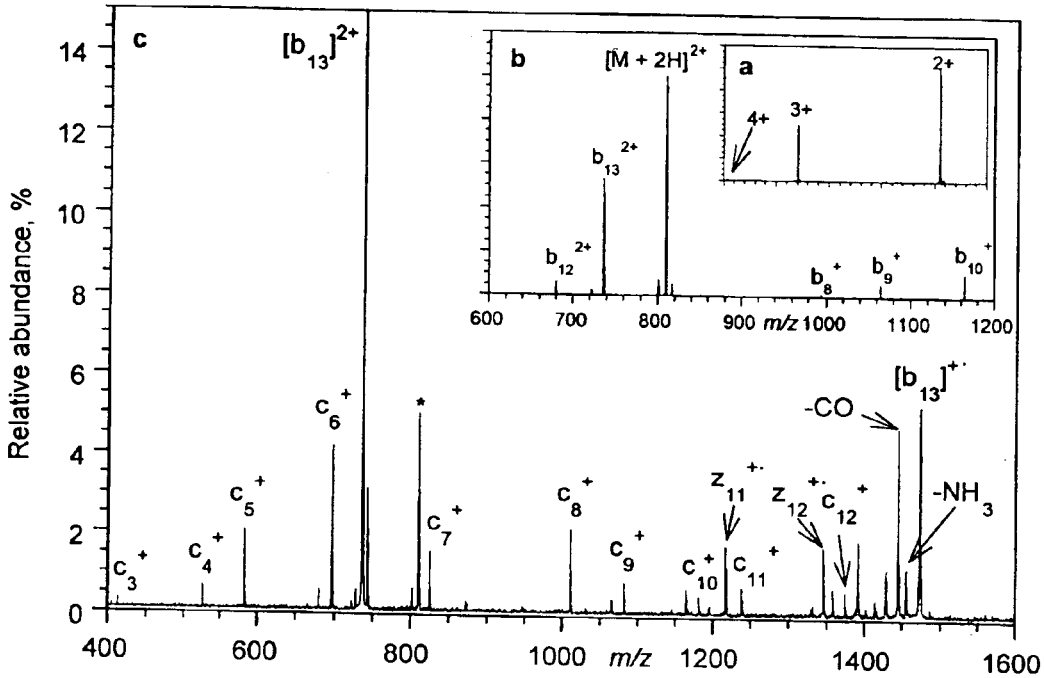
Figure 8:
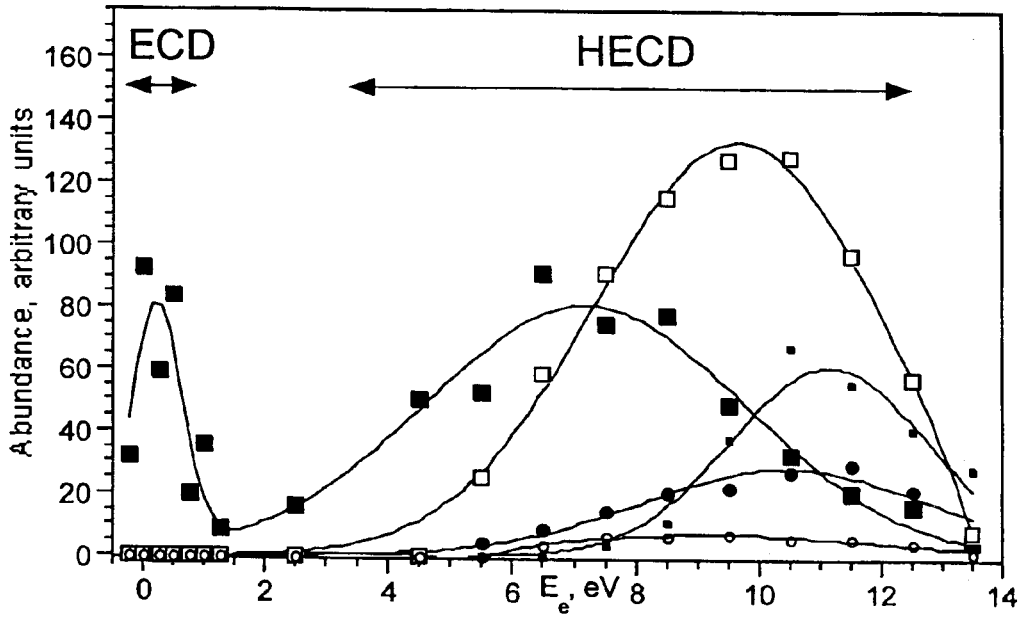
FIG. 8 shows fragment ion abundances versus electron energy $E_e$ for 250 ms electron irradiation of doubly charged SPR peptide molecular ions: ■-N—$C_\alpha$ bond cleavages, □-C—N bond cleavages, ○-$z_4^{+\cdot}$ fragments, •-$w_4^{+\cdot}$ fragments; 1+:,-C—N bond cleavages.
Figure 9:
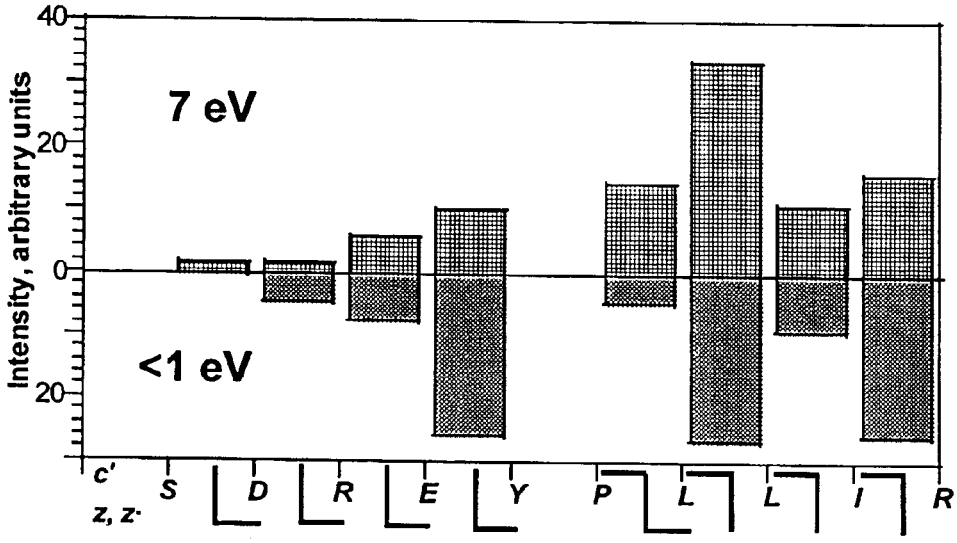
FIG. 9: N—C cleavage abundances in the mass spectra of 2+ ions of SRP at different energies of irradiating electrons.

FIG. 7 demonstrates that the increased sensitivity allows performing $MS^3$ on peptide parent ions. The inset (a) shows the mass spectrum of parent ions with the charge states from 2+ to 4+. increasing the residence time of ions in the electrospray interface from 0.5 to 3.5 seconds leads to dissociation of their peptide bonds with production of b and y ions, as shown in insert (b). The intense fragment $b_{13}^{2+}$ ions were isolated in the cell and irradiated with electrons for 50 ms, which resulted in the spectrum (c). Below the spectrum in FIG. 7, two amino acid sequences show the fragmentation pattern obtained in electron capture dissociation of molecular parent ions and $b_{13}^{2+}$ ions, respectively. In the latter case, more cleavages were obtained, which provided new and complementary structural information as compared to spectra of electron irradiation of molecular ions.

Example 2

ECD by "hot" (3–13 eV) electrons—HECD

The following experiment illustrates the features of the above-described HECD reaction. The experiment was performed with a Fourier transform Mass spectrometer as described above. Electrospray-produced dications of the synthetic decapeptide SDREYPLLIR (SPR, signal recognition particle from Saccharomyces cerevisiae) were irradiated for 250 ms by 0–13 eV electrons. Two maxima were observed in the cross-section plot for N—$C_\alpha$ bond cleavage, one at about 0 eV and another at about 7 eV, with full width at half maximum equal to 1 eV and 6 eV respectively. The first region of the effective N—$C_\alpha$ bond cleavage corresponds to the 'normal ECD' regime, as described above. The second maximum, we postulate is due to the novel reaction of hot electron capture dissociation (HECD). That the observed N—$C_\alpha$ bond cleavages indeed involved electron capture is supported by the observation that even longer (400 ms) irradiation of monocations produced only C—N cleavage (b and y fragments) but no N—$C_\alpha$ cleavages. (These b and y' fragments, as well as similar fragments in HECD mass spectra of dications, we believe originate from non-capture EIEIO-type processes).

The normal ECD region extension to the negative energy values and its width in excess of 0.2 eV are both due to the kinetic energy spread of the electrons emitted from a hot surface.

The statistical correlation between the relative abundances of N—$C_\alpha$ cleavage fragments at the electrons energy corresponding to the two maxima was 0.70, indicating that the bond cleavage mechanism is likely the same or similar. The electron current through the FTMS cell was 70 pA in the normal ECD case and 7.8 $\mu$A for HECD, giving 100 times larger cross-section for the first process.

Figure 10:
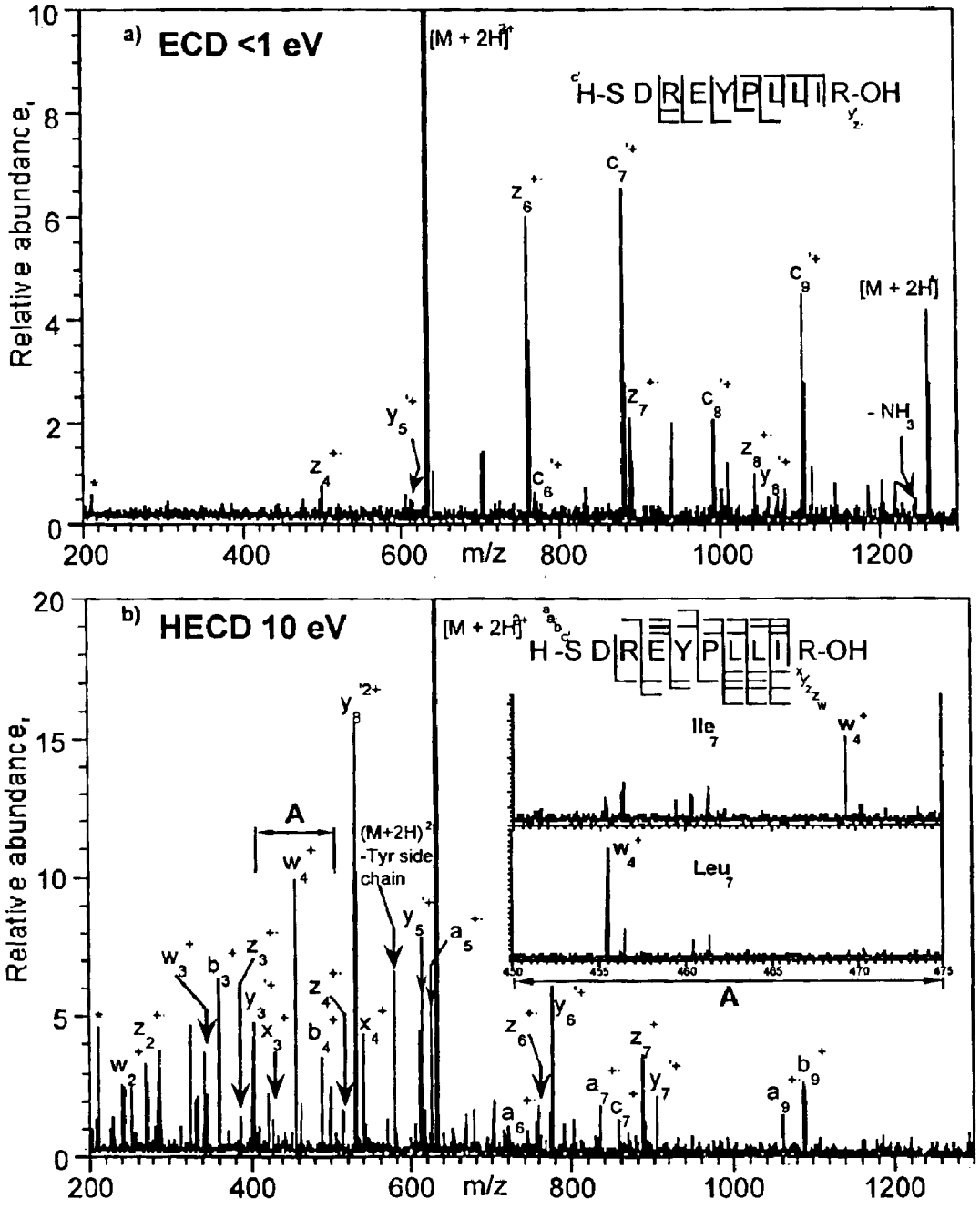
FIG. 10: Mass spectra of the SRP peptide doubly charged molecular ions at different energies of irradiating electrons. Y-scale shows relative abundance in arbitrary units.

Secondary fragmentation: Besides the N—$C_\alpha$ bond cleavage discussed above, HECD gave other fragmentation, with many more bonds cleaved than in normal ECD (cf. FIG. 10). Some of the most abundant fragments are due to secondary fragmentation. This can be expected due to the excess energy in HECD, which is equal to the kinetic energy of the electrons prior to capture. The dissipation channels for the excess energy includes loss of H and larger radical groups near the position of primary cleavage, as discussed above.

What is claimed is:

1. A method of obtaining electron capture by positive ions for use in mass spectrometly comprising:

providing positive ions located during at least a period of time in a spatially limited region;

providing an electron beam which is essentially as broad as said region, and which beam has electron density of sufficient magnitude such that the potential depression created by the electrons is larger or equal to the kinetic energy of the motion radial to said beam of a substantial portion of the ions, to thereby trap said portion of ions;

and wherein at least a part of the electron beam is of low enough energy to provide electron capture by at least a portion of the trapped ions.

2. The method of claim 1, wherein at least a portion of the ions that have captured electrons dissociate to provide fragments ions.

3. The method of claim 1, wherein a force field selected from the group containing a magnetic field, an electric field, an electromagnetic field, or any combination thereof, is used to assist in locating the positive ions within the spatially limited region.

4. The method of claim 1, wherein the electron beam is essentially axial to the direction of a beam or entrance trajectory into the spatially limited region of said positive ions.

5. The method of claim 1, wherein the electron beam is a pulsed electron beam.

6. The method of claim 2, wherein additional fragmentation devices are applied to dissociate ions that have captured electrons.

7. The method according to claim 6, wherein the additional fragmentation devices provide collisionally activated dissociation of ions that have captured electrons.

8. The method according to claim 6, wherein the additional fragmentation devices comprise a source of electromagnetic irradiation, including infrared irradiation.

9. The method of claim 1 wherein said positive ions are selected of desired mass to charge ration prior to the step of electron capture.

10. The method of claim 9, wherein at least a portion of the mass to charge selected ions that have captured electrons dissociate to provide fragments ions of the selected ions.

11. The method of claim 1, wherein the positive ions are multiply charged ions provided by electrospray ionization.

12. The method of claim 1, wherein the positive ions are multiply charged polypeptide ions.

13. The method according to claim 1, where at least a part of the electron beam has an energy in the range of about 0 to about 1.0 eV to provide electron capture by at least a portion of the ions.

14. The method according to claim 13, wherein the at least part of the electron beani has an energy of less than about 0.5 eV.

15. The method according to claim 1, wherein at least a part of the electron beam has an energy in the range of about 2–14 eV to provide electron capture by at least a portion of the ions.

16. The method according to claim 15, wherein at least part of the electron beam has an energy in the range of about 6–12 eV.

17. A method of obtaining a mass spectrum of fragment ions of a sample, comprising:

obtaining electron capture dissociation of sample ions by the method of claim 2;

detecting the mass to charge ration of obtained fragment ions with a mass spectrometry detector to obtain a mass spectrum of the fragment ions.

18. The method of claim 17, wherein the sample ions are selected from the group consisting of polypeptide ions, carbohydrate ions, and organic polymer ions.

19. The method of claim 17, wherein the sample ions comprise polypeptide ions.

20. A mass spectrometer for the analysis of samples, comprising:

an ion source to provide positively charged ions;

a locator to locate at least a portion of said positively charged ions during at least a period of time in a spatially limited region;

an electron source which source provides an electron beam which is essentially as broad as said spatially limited region, and having an electron density of at least about 50 $\mu A/mm^2$, thereby providing sufficient magnitude such that the attractive potential of the electrons in the beam is larger than or equal to the average kinetic energy of the motion of the trapped ions radial to said beam;

and wherein at least a part of the electron beam has an energy selected from the range of about 0–1.0 eV and the range of about 2–14 eV, to provide electron capture by at least a portion of the trapped ions;

a detector to detect the mass to charge ratio of sample ions; and an output device to provide a mass spectrum of said detected sample ions.

21. The mass spectrometer according to claim 20, wherein the electron beam is essentially axial to the direction of a beam or entrance trajectory into the spatially limited region of said positive ions.

22. The mass spectrometer according to claim 20, wherein the ion source is an electrospray ion source providing multiply charged ions.

23. The mass spectrometer according to claim 20, wherein said locator locates the at least a portion of positively charged ions comprise an ion trap within a Fourier transform mass spectrometer.

24. The mass spectrometer according to claim 20, wherein said locator locates the at least a portion of positively charged ions comprise a quadrupole ion trap.

25. The mass spectrometer according to claim 20, wherein said locator locates the at least a portion of positively charged ions comprise a multipole ion guide.

26. The mass spectrometer according to claim 20, further comprising a selector to select ions of desired mass to charge ratio to locate in the spatially limited region prior to the step of electron capture.

27. The mass spectrometer according to claim 20, wherein the detector to detect the mass to charge ratio of sample ions is selected from the group containing: a quadrupole ion trap, a quadrupole mass spectrometer, a Fourier transform ion cyclotron resonance mass spectrometer, a time of flight mass spectrometer, and a magnetic sector mass spectrometer.

* * * * *